United States Patent [19]

Stenz et al.

[11] 4,149,766

[45] Apr. 17, 1979

[54] SCREWLESS TERMINALS FOR ELECTRICAL CONDUCTORS

[75] Inventors: Paul Stenz; Manfred Wilmes; Werner Strich, all of Detmold, Fed. Rep. of Germany

[73] Assignee: C. A. Weidmuller KG, Detmold, Fed. Rep. of Germany

[21] Appl. No.: 910,037

[22] Filed: May 26, 1978

[30] Foreign Application Priority Data

May 28, 1977 [DE] Fed. Rep. of Germany ..... 2724354
Jul. 7, 1977 [DE] Fed. Rep. of Germany ..... 2730680

[51] Int. Cl.[2] ..... H01R 9/06
[52] U.S. Cl. ..... 339/95 D
[58] Field of Search ..... 339/95 D, 198 GA

[56] References Cited

U.S. PATENT DOCUMENTS 3,671,924 6/1972 Nagano ..... 339/95 D

FOREIGN PATENT DOCUMENTS 2062158 7/1972 Fed. Rep. of Germany ..... 339/95 D
1269654 4/1972 United Kingdom ..... 339/95 D

*Primary Examiner*—Joseph H. McGlynn
*Attorney, Agent, or Firm*—Pollock, Vande Sande & Priddy

[57] ABSTRACT

A screwless electrical terminal unit comprises a pair of parallel channels for receiving respective conductors, with the open sides of the channels facing one another. Between the channels is mounted a W-shaped leaf spring with its central bend mounted on a retaining member, each outer bend adjoining an abutment between the outer bends to limit movement of the latter, and the free limbs extending obliquely towards respective channels for clamping conductors therein. Such an arrangement ensures that manipulation of one limb of the spring has no effect on the clamping of a conductor by the other limb. A rocker member may be provided for selectively moving the free limbs from their conductor-clamping positions.

18 Claims, 15 Drawing Figures

Figure 3A:
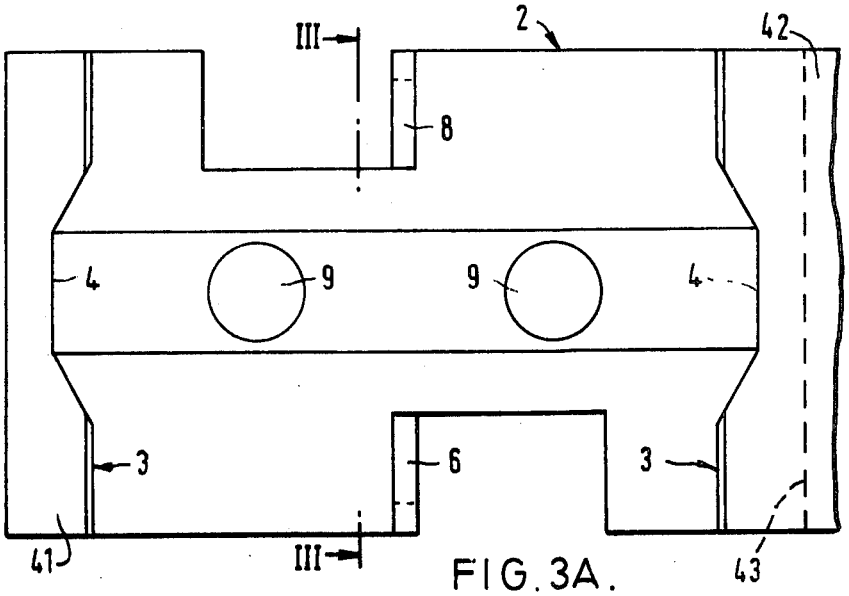

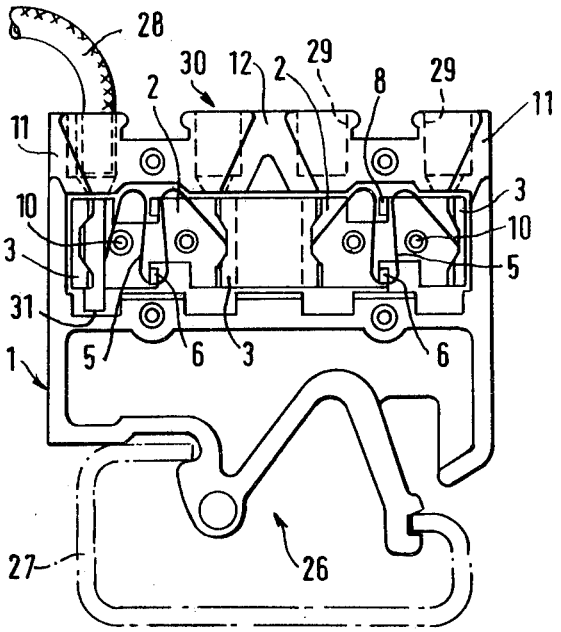
FIG. 1.
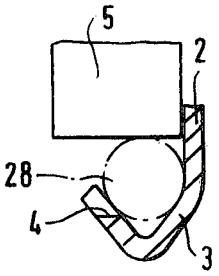
FIG. 2A.
FIG. 2.
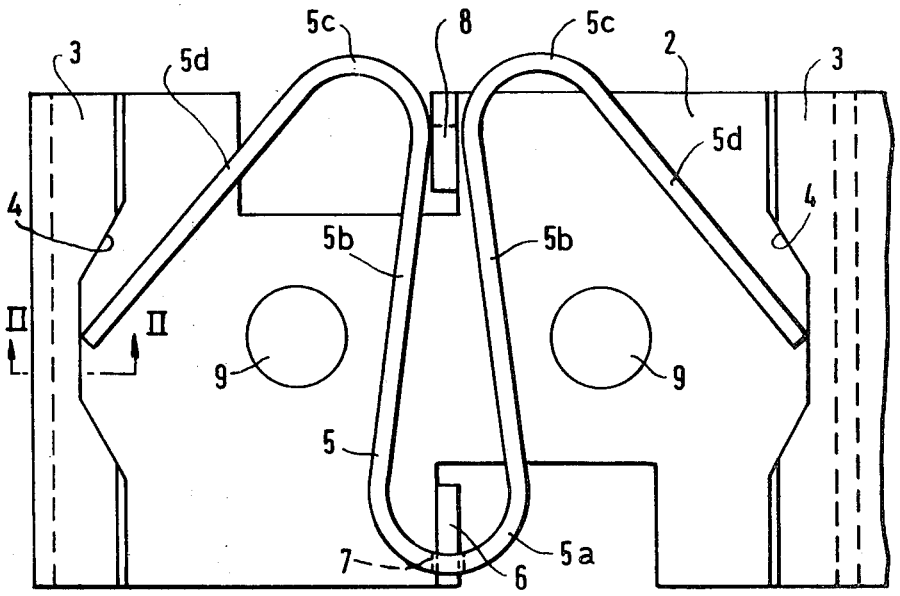

SCREWLESS TERMINALS FOR ELECTRICAL CONDUCTORS

The invention relates to a screwless terminal unit for electrical conductors, having at least two adjacent terminals comprising respective channels formed from a current-carrying part for holding the conductors and a common leaf spring for both channels of adjacent terminals which spring has free ends oriented obliquely towards the channels.

Screwless terminal units of the kind described above are known, in which the common leaf spring is substantially V or U-shaped and is retained in the region of the bent or curved portion by a holder, generally formed from the current-carrying part. These have the disadvantage that retention of the leaf spring in the holder is insufficient since clamping of a conductor, already inserted into one of the terminals, is impaired if a conductor is inserted in the adjacent terminal or if an existing conductor clamped in the latter terminal is released. The risk resulting therefrom is increased by the fact that such assembling operations frequently feature not very careful handling of the conductors, so that the clamping positions are frequently subjected to very substantial loads. A further disadvantage is that assembly of the terminals is difficult to automate.

It is therefore the object of the present invention to provide screwless terminals of a simple construction and simple assembly procedure, and in which two adjacent terminals can be processed used independently of each other and without mutual interference both when clamping a conductor and when releasing a conductor.

According to the invention there is provided a screwless terminal unit for electric conductors, having at least two adjacently disposed terminals comprising respective channels formed from a current-carrying part for holding the conductors, and a common leaf spring disposed between the two channels of the adjacent terminals, in which the leaf spring has a substantially central bend, a respective first limb adjoining the said bend on each side and extending to respective oppositely oriented second bends with an opposite curvature, and respective free limbs extending from said second bends obliquely towards the channels, the substantially central bend of the leaf spring is secured on a retaining member and each second bend is disposed facing an abutment member disposed between said second bends and arranged to resist motion of the second bends away from the associated channels.

By providing the leaf spring with the said shape and by supporting the leaf spring in the said manner, three-point support is provided on both sides of the leaf spring, namely firstly at the conductor-clamping place, secondly between the central bend and the retaining member, and thirdly between each of the reverse bends and the abutment member, i.e., between the first and second support points. The three-point support for each side of the spring ensures that clamping a conductor as well as releasing the clamping connection of a conductor at one terminal leaves the connection at the other terminal completely unifluenced. Consequently the transfer resistance of a connection already made practically does not alter, whereas in the past the fluctuating transfer resistances in adjacently disposed connections with a common leaf spring were regarded as particularly detrimental.

In order to additionally contribute to ensuring that the transfer resistance of a connection already made does not alter if manipulations are performed on the adjacent connection, the channels preferably have a deep, prismatic cross-section, and the free limbs of the leaf spring are each situated opposite a recess of and terminate in the corresponding channels.

The deep cross section for conductor reception, away from the recess, ensures a reliable contact position of the conductor in the channel, combined with excellent positive guiding of the conductor into the terminal, and completely flawless clamping takes place in the region of the recess despite the relatively large depth of the channel, a feature which also offers the advantage that even relatively thin conductors can be reliably clamped at the recess when necessary.

It is a special advantage of the inventive arrangement of the leaf spring and of its retaining means that the leaf spring can be installed by an insertion motion parallel to the conductor insertion direction, a motion which can be very simply automated by contrast to an insertion motion from one side.

Preferably the leaf spring is made broader than the channels so that, depending on the kind of terminal unit, it is possible to act from any side on the projecting leaf spring edge for releasing the clamping, if a corresponding insertion slot is provided in the terminal casing so that the spring can be actuated from outside the actual clamping region by means of a tool.

Alternatively the terminal unit may incorporate spring-releasing means preferably comprising a lever rocker which when pivoted releases a selected spring end.

Figure 3B:
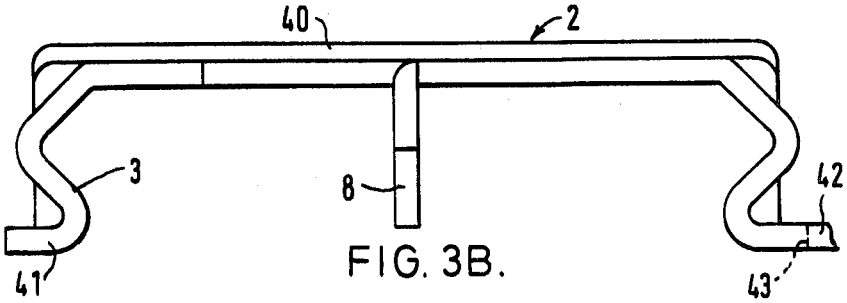
Figure 3C:
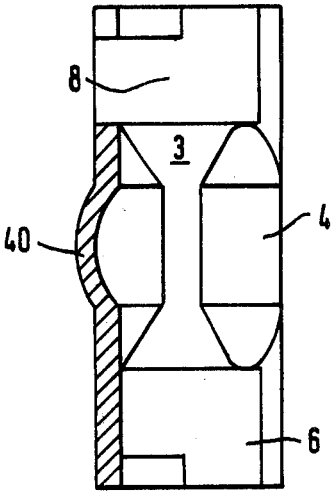
Figure 4:
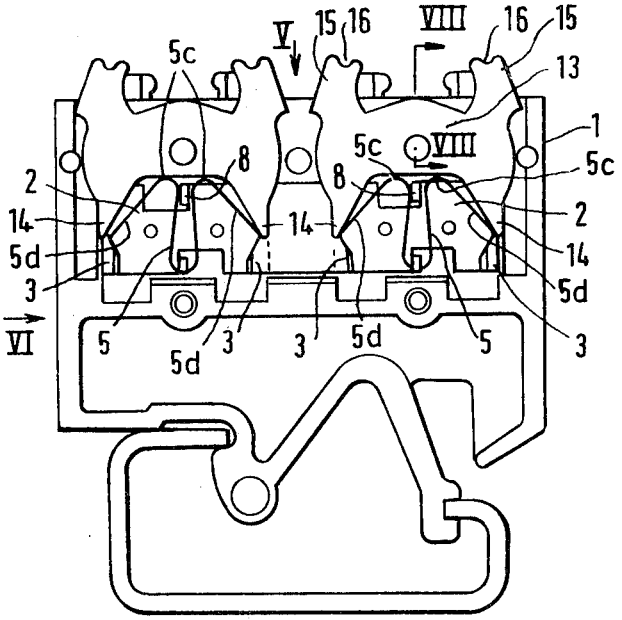
Figure 6:
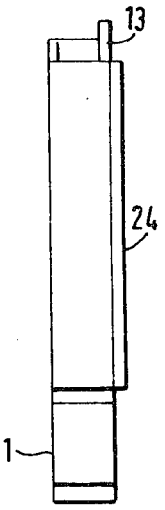
Figure 5:
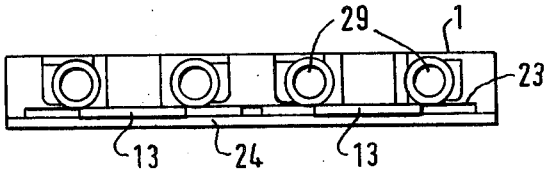
Figure 7:
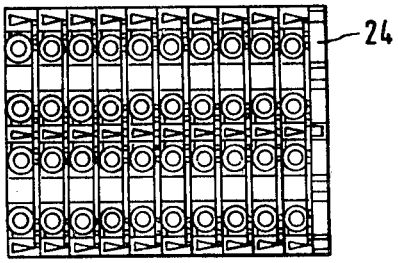
Figure 8:
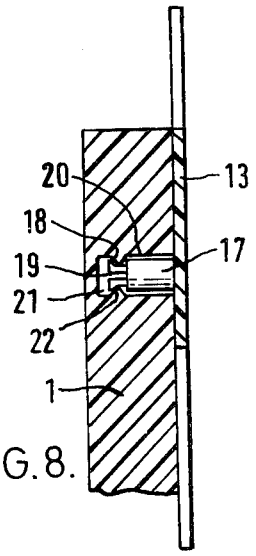
Figure 9:
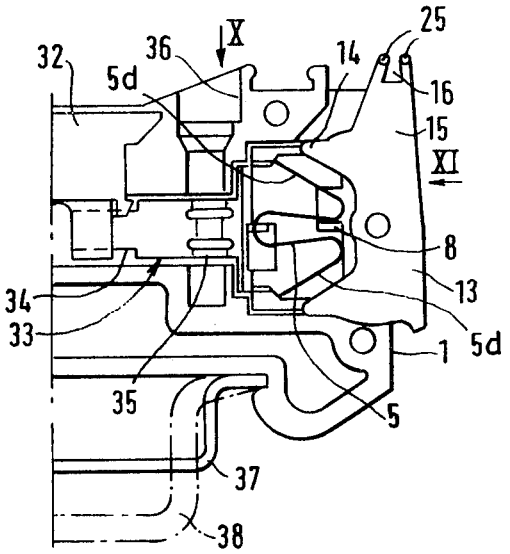
Figure 11:
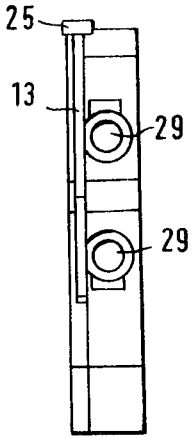
Figure 10:
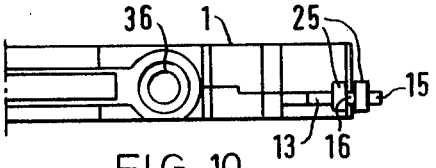
Figure 12:
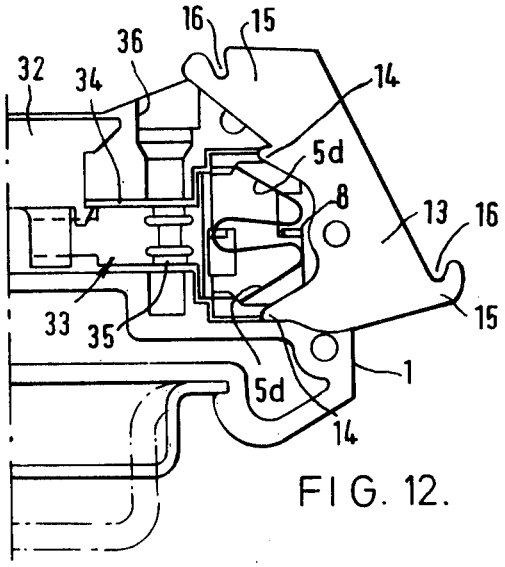

Embodiments of the invention are described hereinbelow by reference to the accompanying drawings in which:

FIG. 1 is a first screwless terminal unit according to the invention shown in side view, FIG. 2 shows on current-carrying part together with a leaf spring, to an enlarged scale, FIG. 2A is a partial sectional view along the line II—II of FIG. 2, FIGS. 3A to 3C show a second current-carrying part in elevation, in plan, and in section on line III—III respectively, FIG. 4 is a side view of a second screwless terminal unit according to the invention, FIG. 5 is a view in the direction of the arrow V of FIG. 4, FIG. 6 is a view in the direction of the arrow VI in FIG. 4, FIG. 7 shows a plurality of terminal units according to the invention combined into a block, FIG. 8 is a section along the line VIII—VIII of FIG. 4, FIG. 9 is a part-view of a screwless terminal unit according to another embodiment of the invention, FIG. 10 is a view in the direction of the arrow X of FIG. 9, FIG. 11 is a view in the direction of the arrow XI of FIG. 9 and FIG. 12 is a part-view of a terminal unit according to another embodiment of the invention.

FIG. 1 shows a block terminal unit of the kind comprising a generally slab-shaped insulating body or casing 1 of moulded plastics material incorporating mounting means 26 adapted to be clipped onto and unclipped from a metal supporting rail 27, shown as being of asymmetrical cross section with in-turned flanges engageable by notches of the mounting means.

The terminal unit has two adjacent interconnected pairs of interconnected terminals for receiving electrical conductors 28 inserted through holes 29 in the top narrow face 30 of the casing. Each pair of terminals comprises a current-carrying part 2 of sheet metal, and a generally W-shaped leaf spring 5. In the embodiment shown, the two current-carrying parts 2 are formed by a single piece of metal, but they could be separate parts interconnected permanently or separably e.g. by a switch as in FIGS. 9 to 12, described below.

The casing 1 is recessed in one of its major side faces, to receive the terminals. In use the recess, which is open, is covered by an adjacent terminal or a cover plate, e.g. as shown at 24 in FIGS. 6 and 7.

Each terminal comprises a channel 3, in which a conductor can lie.

The channels 3 have a prismatic cross-section (in particular a V-section channel), as can be seen more particularly by reference to FIG. 2A, and are sufficiently deep to ensure that an inserted conductor bears not merely in the top edge region of the cross-section of the prism but, owing to the prismatic form, is guided relatively far into the opening of the prism on being inserted so that it is able to bear flush on both surfaces of the prism. A recess 4 is provided in the middle region of each channel 3 in the region where the inserted conductor can be clampingly retained by the associated leaf springs. The recess 4 offers the advantage that relatively thin conductors can also be reliably clamped, since it enables the spring 5 to approach closely the bottom of the channel 3, as will be understood from FIGS. 2 and 2A. The recesses can be formed by cutting away or flattening the metal of the part 2 in the appropriate region.

As can be seen, more particularly by reference to FIG. 2, a common leaf spring 5 is provided for both channels 3 of a pair of terminals. The leaf spring 5 has an arcuate central bend **5*a* between limbs 5*b* which in turn merge into oppositely disposed and oppositely arcuately curved reverse bends 5*c*, beyond which respective free or end limbs 5*d* extend obliquely towards the recesses 4 of the channels 3 and terminate at the recesses at an oblique angle to the conductor insertion or extraction direction so that, in conjunction with the channels 3, the ends of the spring define clamping gaps and can resiliently clamp an inserted conductor 28 (see FIG. 1) in the channel 3. The obliquity of the spring limbs 5*d*** facilitates insertion and resists extraction of the conductor.

From the current-carrying part there is also formed a retaining lug 6 of hook-shaped construction which hook engages in an opening 7 at the apex of curvature of the central bend **5*a* of the leaf spring 5. Opposite the lug 6 is a support or abutment lug 8, formed from the current-carrying part 2 and situated between the two bends 5*c* of the leaf spring 5 so that the two bends 5*c* bear on opposite sides of the lug 8. Each half of the leaf spring 5, associated with one of the channels 3, is thus provided with three-point support, firstly in the clamping gap on the conductor, secondly by virtue of the bend 5*c* bearing on the lug 8, and finally by retention of the middle bend 5*a* on the retaining lug 6**. As a result, any manipulation of one clamping portion of such a leaf spring has no effect on the clamping action of the other clamping portion of the leaf spring.

This design also offers the advantage that the leaf spring 5 can be mounted on the current-carrying part 2 in a simple manner by a rectilinear insertion motion parallel to the longitudinal direction of the channels. The insertion motion is continued until the hook of the retaining lug 6 engages in the opening 7 of the spring 5. Such an insertion motion can be automated in a very simple manner.

Preferably the opening 7 is symmetrically placed with respect to the width of the leaf spring, so that the leaf spring can be mounted in either lateral position on the current-carrying part 2.

If the lug 8 is constructed in hook-shaped form in the same way as the retaining lug 6, and if the current-carrying part 2 together with the channels 3. integrally formed thereon is also symmetrical, a completely symmetrical construction is obtained so that the current-carrying part can be fitted with the leaf spring 5 from either side at will, and the side from which the conductor is inserted is defined solely by the fitting direction of the leaf spring. This is of special interest for so-called bushing terminals.

The channels 3 as well as the lugs 6 and 8 are conveniently formed by raising portions from the current-carrying part 2, thus precluding any burrs which may interfere with installation work and more particularly eliminating from the region of the channels any burrs which could result in unintentional spreading of individual strands of an inserted conductor. The current-carrying parts can be contiguously produced on a continuous metal strip and can then be cut off into individual pieces.

The current-carrying parts 2 together with the leaf springs 5 are pre-assembled by the above-mentioned lateral insertion and this pre-assembled subassembly (see FIG. 2) is then laterally inserted into the plastics casing 1. The current-carrying part 2 is also provided with two openings 9 through which limiting studs 10, disposed on the plastics casing 1, enter in the course of the insertion motion, and the studs 10 are then situated practically behind the free limbs **5*d* of the leaf springs 5. These limiting studs provide protection against overstressing of the leaf springs, because they allow the free limbs 5*d* of the leaf springs 5** to be forced back only by a pre-defined amount when a conductor is inserted.

The leaf spring 5 is broader than would correspond to the greatest distance between the walls of the channels. This means that the leaf spring 5 projects laterally beyond the channels 3. This permits access to the projecting part of the leaf spring from any desired side in a particularly simple manner, in order to release the spring from clamping a conductor. Corresponding insertion slots for a releasing tool will be provided at places on the plastics casing where this is most convenient for the particular kind of block terminal unit i.e., to provide easy accessibility. FIG. 1 show insertion slots 12 and 11 for a releasing tool, which extend downwardly obliquely from the top, and obliquely downwards from the front and the rear narrow sides of the casing.

In terminal units in which, by contrast to the spring block terminal shown in FIG. 1, the insertion depth of the conductors is not defined by a portion 31 of the insulating casing situated at the end of the channel, a stop abutment part for the conductors is conveniently formed on the bottom region of each channel.

The clamping principle described above, with the corresponding construction of the leaf spring and of the current-carrying part with the channels, can also be applied to terminals of a kind other than the spring block terminal unit illustrated in FIG. 1, for example to block terminal units with casings which can be attached to each other to form a terminal strip, to isolating terminal units with or without testing sockets and to block terminal units with cross connections. The current-carrying part or the clamping channel itself can be integrally connected in simple manner to soldering, plug, screw mounting or wire-wrapping terminals. The use of solder connections is particularly advantageous for terminals intended for printed circuits.

FIGS. 3A to 3C show a modified current-carrying part, in which the recesses 4 are formed by flattening of the sheet metal in the central regions of the sides of the channels 3, and a shallow embossed rib 40 is provided to stiffen the region between the two channels. This current-carrying part is made by bending and pressing of a metal strip to form a succession of such current-carrying parts, the strip then being cut across to separate the individual current-carrying parts, or pairs of current-carrying parts with an interconnecting integral web as in the terminal unit shown in FIG. 1. Accordingly, the cutting leaves residual portions of the metal strip as edge flanges 41 adjoining the channels 3 or as said interconnecting web 42. The broken line 43 shows where the metal strip would be cut to form a current-carrying part comprising only a single pair of channels 3. The channels have an included angle of preferably 90°.

FIGS. 4 to 6 show a screwless terminal unit generally similar to that of FIGS. 1 to 3 but provided with means for unclamping conductors.

To release the free limbs 5*d* of the leaf spring 5 from a conductor to enable the conductor to be removed from the terminal, a lever rocker 13 is pivotably supported on the casing 1 above the lug 8 of each current-carrying part 2. The lever rocker 13 is provided with two release levers 14 which are situated above the respective free limbs 5*d* of the leaf spring 5, alongside the channels 3. On the top, the lever rocker 13 is provided with two actuating levers 15 which project slightly upwardly above the caseing 1 and are provided with indentations or notches 16 so that a tool, for example a screwdriver, can be applied without the risk of slipping. With the above-mentioned tool, thrust can be applied to one of the actuating levers 15 to enable the lever rocker 13 to be pivoted. The consequence of such pivoting of the lever rocker 13 is that one of the free limbs 5*d* of the leaf spring 5 is pivoted by means of the corresponding release lever 14, against the clamping direction of said limb. A previously clamped electric conductor can then be effortlessly removed. It is also possible to simplify insertion of an electric conductor, by first thrusting aside the corresponding free limb 5*d* of the leaf spring 5 by means of the lever rocker 13, then inserting the conductor, and then releasing the lever rocker 13 to let the spring limb move into its clamped position.

The lever rocker 13 is integrally constructed of injection-moulded plastics and, as can be readily seen by reference to FIG. 8 it is provided with an integral bearing stud 17 the free end of which has an undercut 18 and a slot 19. A blind receptor bore 20 of the casing has a constriction 22 and terminates in a tapered expanded portion 21. By virtue of this construction, the bearing stud 17 can be snapped into the receptor bore 20 and is thus reliably located.

As can be clearly seen by reference to FIG. 5, the lever rockers 13 are situated in a recess 23 of the casing 1 and the depth of the recess 23 corresponds to the thickness of the lever rockers 13. This means that the lever rockers 13 do not project beyond the lateral boundary surfaces of the casing 1. As a result it is readily possible, as indicated in FIG. 7, for such terminal units to be combined in known manner into a block. A cover plate 24 is arranged only at the front of the block to conceal the current-carrying parts of the front terminal unit and also the lever rockers 13 of the said front terminal unit.

It is also feasible to place the lever rockers 13 on the casing 1 and to provide the opposite side of the casing with a corresponding recess so that when a plurality of terminal units are assembled into a block the lever rockers 13 of one terminal unit are situated in the corresponding recess of the succeeding terminal unit.

FIGS. 9 to 12 show further embodiments of the invention in which the connections of the terminals are accessible not at the top but at the sides of the casing.

FIGS. 9 to 11 show a lever rocker 13, the two release levers 14 of which are situated adjacent to the leaf spring limbs 5*d* on the side of the latter from which the conductors are inserted, and which is provided with an actuating lever 15 which extends above the top of the casing 1 and is provided with a recess 16 for the introduction of a suitable tool. The recess 16 in FIGS. 9 to 11 is conically expanded in the downward direction and its top is defined by two stud-like thickened portions 25. This construction facilitates operation of the rocker lever 13 to the left or to the right, depending on which of the free limbs 5*d* of the leaf spring is to be released from a clamped position.

FIG. 12 shows a terminal unit in which the conductors are also inserted from the sides but in which the lever rocker 13 is provided with two actuating levers 15 and corresponding indentations 16 for the insertion of a tool.

It is evident from these few illustrated embodiments that the special shape of the lever rocker 13 must be defined in accordance with the position of the terminals. It is important therefore that the actuating levers 15 of the lever rockers 13 are arranged so that they are in the most readily accessible position.

In FIGS. 9 and 12, disconnecting switches 32 are shown, for isolating the illustrated current-carrying part 33 from an indentical symmetrically placed current-carrying part (not shown). Each current-carrying part 33 comprises a pair of channels 3 and lugs, 6, 8, generally as shown in FIGS. 1A and 2, but integral with a metal stem 34 extending, parallel to the channels, towards the switch 32. The stem 34 has arcuate portions 35 defining a socket for a test probe, accessible through a hole 36 in the top of the casing.

FIGS. 9 and 12 also show an alternative mounting means for clipping onto a support rail 37 or 38 of symmetrical cross section with out-turned flanges.

We claim:

1. A screwless terminal unit for electric conductors, having at least two adjacently disposed terminals comprising respective channels formed from a current-carrying part for holding the conductors, a common leaf spring disposed between the two cages of the adjacent terminals, which leaf spring has a substantially central bend, a respective first limb adjoining the said bend on each side and extending to respective oppositely oriented second bends with an opposite curvature, and respective free limbs extending from said second bends obliquely towards the channels, a retaining member on which the substantially central bend of the leaf spring is secured, and an abutment member disposed between and facing said second bends and arranged to resist motion of the second bends away from the associated channels.

2. A terminal unit according to claim 1, in which the free limbs of the leaf spring are each situated opposite a recess provided in, and terminate in, the channels, which channels have a deep, prismatic cross-section.

3. A terminal unit according to claim 1 in which the abutment member is constructed in the same manner as the retaining member.

4. A terminal unit according to claim 1 in which the openings are provided in the current-carrying part in the region behind the free limbs of the leaf spring, and the terminal unit has a casing provided with limiting studs which project through said openings for limiting the movement of the free limbs.

5. A terminal unit according to claim 1 in which the retaining member and the abutment member are formed from the current-carrying part.

6. A terminal unit according to claim 3 in which the channels, and the said members are formed by raising from the current-carrying part.

7. A terminal unit according to claim 1 in which the retaining member is hook-shaped and engages an opening provided in the substantially central bend of the leaf spring.

8. A terminal unit according to claim 7 in which the opening is centrally disposed with respect to the width of the leaf spring.

9. A terminal unit according to claim 1 in which the leaf spring is broader than the largest cross-sectional width of the channels and projects laterally beyond said channels.

10. A terminal unit according to claim 9 having a casing provided with entry apertures which extend from the outside of the casing to a portion of the leaf spring which projects beyond the channels.

11. A terminal unit according to claim 1 including means operable to move said free limbs selectively away from the respective channels.

12. A terminal unit according to claim 11 in which the said means is a lever rocker pivotably supported approximately in the middle thereof, on that side of the abutment member remote from the retaining member, and is provided with two release levers situated adjacent to respective free limbs of the leaf spring and with at least one actuating lever which projects slightly from a casing of the terminal unit.

13. A terminal unit according to claim 12 in which the lever rocker is integrally injection-moulded from plastics.

14. A terminal unit according to claim 12 in which the lever rocker is situated in a recess of the casing.

15. A terminal unit according to claim 12 in which the or each operating lever of the lever rocker is provided with an indentation.

16. A terminal unit according to claim 12 in which the lever rocker has only one actuating lever, which is provided with a downwardly conically expanded indentation which is defined at its top end by two stud-like thickened portions.

17. A terminal unit according to claim 12 in which the lever rocker is secured by means of a snap connection on the casing.

18. A terminal unit according to claim 17 in which the lever rocker is provided with a bearing stud which has an undercut in the region of its free end which bearing stud is snapped into a blind bore of the casing which bore is provided with a constriction.

* * * * *